US008568190B2

(12) United States Patent
Nelson et al.

(10) Patent No.: US 8,568,190 B2
(45) Date of Patent: Oct. 29, 2013

(54) BALLOON SEALING AND DISPLAYING DEVICE

(75) Inventors: David C. Nelson, Akron, OH (US); Wesley A. Schroeder, Seville, OH (US)

(73) Assignee: Premium Balloon Accessories, Inc., Sharon Center, OH (US)

( * ) Notice: Subject to any disclaimer, the term of this patent is extended or adjusted under 35 U.S.C. 154(b) by 0 days.

(21) Appl. No.: 13/363,746

(22) Filed: Feb. 1, 2012

(65) Prior Publication Data

US 2013/0193355 A1 Aug. 1, 2013

(51) Int. Cl.
*A63H 27/10* (2006.01)

(52) U.S. Cl.
USPC ..... 446/220; 24/30.5 S; 24/129 R

(58) Field of Classification Search
USPC ..... 446/220–226; 289/1.5, 17; 24/30.5 S, 24/563, 129 R, 130
See application file for complete search history.

(56) References Cited

U.S. PATENT DOCUMENTS

| | | | | | |
|---|---|---|---|---|---|
| 363,495 | A | * | 5/1887 | Wilson, Jr. | 24/130 |
| 479,509 | A | * | 7/1892 | Heaphy, Jr. | 24/130 |
| 656,431 | A | * | 8/1900 | Stewart | 24/130 |
| 1,008,810 | A | * | 11/1911 | Freese | 402/13 |
| 1,065,190 | A | * | 6/1913 | Tobin | 439/450 |
| 1,205,496 | A | * | 11/1916 | Whitehead | 24/129 R |
| 1,330,968 | A | * | 2/1920 | Woods | 24/570 |
| 1,383,665 | A | * | 7/1921 | Rohan | 24/129 B |
| 1,426,537 | A | * | 8/1922 | Bauer | 24/130 |
| 1,469,281 | A | * | 10/1923 | Stevens | 24/563 |
| 1,680,318 | A | * | 8/1928 | Callahan | 446/222 |
| 1,806,162 | A | * | 5/1931 | Hahn | 24/712.6 |
| 2,174,192 | A | * | 9/1939 | Meighan | 24/129 R |
| 2,193,236 | A | * | 3/1940 | Meighan | 24/129 R |
| 2,271,288 | A | * | 1/1942 | Cuff | 24/130 |
| 2,396,906 | A | * | 3/1946 | Windson | 446/222 |
| D182,259 | S | * | 3/1958 | Tupper | D6/315 |
| 2,981,990 | A | * | 5/1961 | Balderree, Jr. | 24/30.5 R |
| 3,267,540 | A | * | 8/1966 | Wolcott et al. | 24/130 |
| 3,348,272 | A | * | 10/1967 | Germani | 24/563 |
| 3,353,232 | A | * | 11/1967 | Brownson | 24/129 R |
| 3,675,276 | A | * | 7/1972 | Nuse | 24/130 |
| 3,736,925 | A | * | 6/1973 | Erman | 606/204.35 |
| 4,355,444 | A | * | 10/1982 | Haney | 24/129 B |
| 4,361,935 | A | * | 12/1982 | Paxton | 24/30.5 R |

(Continued)

FOREIGN PATENT DOCUMENTS

| | | | | |
|---|---|---|---|---|
| EP | 0956889 | | 11/1999 | |
| GB | 2186905 | A * | 8/1987 | A44B 21/00 |

(Continued)

*Primary Examiner* — Gene Kim
*Assistant Examiner* — Urszula M Cegielnik
(74) *Attorney, Agent, or Firm* — Renner Kenner Greive Bobak Taylor & Weber

(57) ABSTRACT

A balloon sealing and display device comprises a disk-like body member that includes a first sealing slit formed therein, extending from an open mouth inwardly to a closed end. The disk-like body member also includes a second sealing slit formed therein extending from an open mouth inwardly to a closed end. The closed end of the first sealing slit and the closed end of the second sealing slit are spaced apart from one another to define a neck wrap portion of the body member. The disk-like body member also includes a ribbon wrap portion. The balloon sealing and display device also includes a ribbon, having a first end and a second end defining a length thereof, having the first end secured to the body member.

16 Claims, 4 Drawing Sheets

(56) References Cited

U.S. PATENT DOCUMENTS

| | | | | | |
|---|---|---|---|---|---|
| 4,414,716 | A | * | 11/1983 | Stastney | 24/3.12 |
| 4,509,231 | A | * | 4/1985 | Paxton | 24/30.5 R |
| 4,510,653 | A | * | 4/1985 | Semanko | 24/131 C |
| 4,694,542 | A | * | 9/1987 | Koppe | 24/30.5 S |
| 4,760,624 | A | * | 8/1988 | Fish | 24/30.5 S |
| 4,881,916 | A | * | 11/1989 | Houser | 446/222 |
| 4,939,820 | A | * | 7/1990 | Babcock | 24/129 R |
| 4,989,906 | A | * | 2/1991 | Peverley | 289/17 |
| 5,104,160 | A | | 4/1992 | Cheng | |
| 5,138,748 | A | * | 8/1992 | Welles | 24/30.5 S |
| 5,311,646 | A | * | 5/1994 | Eischen, Sr. | 24/30.5 S |
| D359,229 | S | | 6/1995 | Jules | |
| 5,575,046 | A | * | 11/1996 | Rourke | 24/563 |
| 5,625,925 | A | * | 5/1997 | Richards | 24/129 B |
| 5,628,091 | A | * | 5/1997 | Mueller | 24/3.2 |
| 5,647,615 | A | * | 7/1997 | Messier | 289/2 |
| 5,784,763 | A | * | 7/1998 | Cassidy | 24/130 |
| 5,799,377 | A | * | 9/1998 | Carroll et al. | 24/30.5 R |
| 5,882,051 | A | * | 3/1999 | Dreger et al. | 289/17 |
| 6,094,783 | A | * | 8/2000 | Parsons | 24/130 |
| 6,325,426 | B1 | * | 12/2001 | Boesl | 289/1.5 |
| 6,389,652 | B1 | * | 5/2002 | Williams | 24/30.5 R |
| 6,582,272 | B1 | * | 6/2003 | Nelson et al. | 446/220 |
| 6,763,776 | B1 | * | 7/2004 | Perri et al. | 114/218 |
| 6,790,120 | B1 | * | 9/2004 | Murray | 446/220 |
| 7,146,688 | B2 | * | 12/2006 | Yi | 24/129 B |
| 7,150,757 | B2 | * | 12/2006 | Fallin et al. | 606/232 |
| D536,746 | S | * | 2/2007 | Murray | D21/453 |
| D542,360 | S | * | 5/2007 | Murray | D21/453 |
| 7,229,051 | B2 | * | 6/2007 | Mailhot, Jr. | 248/51 |
| 7,249,991 | B1 | * | 7/2007 | Watson | 446/220 |
| 7,380,371 | B2 | * | 6/2008 | Jones et al. | 47/44 |
| 7,566,339 | B2 | * | 7/2009 | Fallin et al. | 606/232 |
| 7,594,923 | B2 | * | 9/2009 | Fallin et al. | 606/232 |
| 7,677,525 | B2 | * | 3/2010 | Sanchez et al. | 248/690 |
| 7,722,644 | B2 | * | 5/2010 | Fallin et al. | 606/232 |
| 7,806,909 | B2 | * | 10/2010 | Fallin et al. | 606/232 |
| 8,209,823 | B2 | * | 7/2012 | Apicella | 24/130 |
| 2004/0077268 | A1 | * | 4/2004 | Wainohu | 446/222 |
| 2004/0198146 | A1 | * | 10/2004 | Murray et al. | 446/220 |
| 2006/0292959 | A1 | * | 12/2006 | Greenwald et al. | 446/220 |
| 2006/0292960 | A1 | * | 12/2006 | Muller | 446/220 |
| 2007/0101554 | A1 | * | 5/2007 | O'Brien | 24/129 R |
| 2008/0085655 | A1 | | 4/2008 | Boise | |
| 2008/0184533 | A1 | * | 8/2008 | Kelly | 24/129 R |
| 2010/0275418 | A1 | * | 11/2010 | Ingram | 24/129 R |

FOREIGN PATENT DOCUMENTS

| | | | | | |
|---|---|---|---|---|---|
| GB | 2379619 | | | 3/2003 | |
| GB | 2379619 | A | * | 3/2003 | A63H 27/10 |
| GB | 2433446 | A | * | 6/2007 | A63H 27/10 |
| JP | 01052496 | A | * | 2/1989 | A63H 27/10 |
| JP | 06079067 | A | * | 3/1994 | A63H 27/10 |
| JP | 2001300150 | A | * | 10/2001 | A63H 27/10 |
| WO | WO 03055567 | A1 | * | 7/2003 | A63H 27/10 |

* cited by examiner

BALLOON SEALING AND DISPLAYING DEVICE

FIELD OF THE INVENTION

This invention relates generally to a balloon sealing device, and more particularly to a balloon sealing device that has a neck in which a ribbon may be attached and which is safe to use with balloons filled with air or gases lighter than air.

BACKGROUND OF THE INVENTION

Balloons filled with air or gases lighter than air are commonly used as decorations at parties, marketing promotions, sporting rallies, and as toys. For such events, it is common that a large number of balloons are filled, the necks of the balloons are then tied in a knot to then be secured to a string or "ribbon," and then the balloons floating on the ribbon are displayed.

A common problem with tying a large number of balloons for a gathering is that the resilient nature of the material from which balloons are produced is such that one's fingertips are constantly strained and pinched and will often become tender and sore. In many instances, adults find that their fingers are too large to tie the small balloons. In other instances, adults may have arthritis or limited dexterity of their fingers, which makes tying a knot in the balloon difficult.

Balloon tying devices and methods are known in the art for sealing the neck of a balloon to prevent deflation. In most instances in which there is a need for a balloon, there is also a need for the balloon to have ribbon or string attached to it, particularly when presenting a lighter-than-air balloon which must be tethered to prevent its floating away. There is a need in the art for a means to associate ribbon or string with the sealing device because currently there is no means for accomplishing this. The present invention sets out to fill this need.

SUMMARY OF THE INVENTION

In a first embodiment the present invention provides a balloon sealing and display device comprising a disk-like body member that includes a first sealing slit formed therein, extending from an open mouth inwardly to a closed end. The disk-like body member also includes a second sealing slit formed therein extending from an open mouth inwardly to a closed end. The closed end of the first sealing slit and the closed end of the second sealing slit are spaced apart from one another to define a neck wrap portion of the body member. The disk-like body member also includes a ribbon wrap portion. The balloon sealing and display device also includes a ribbon, having a first end and a second end defining a length thereof, having the first end secured to the body member.

In a second embodiment this invention provides a balloon sealing and display device as in the first embodidment, wherein the first end of the ribbon is secured at the neck wrap portion.

In a third embodiment this invention provides a balloon sealing and display device as in the first or second emboidments, wherein the majority of said ribbon is wrapped around the ribbon wrap portion of the device.

In a fourth embodiment this invention provides a balloon sealing and display device as in any of the first through third embodiments, wherein the ribbon slit in said body member is sized to receive the ribbon therein and pinch and hold the same.

In a fifth embodiment this invention provides a balloon sealing and display device as in any of the first through fourth embodiments, wherein the ribbon slit is formed in the ribbon wrap portion.

In a sixth embodiment this invention provides a balloon sealing and display device as in any of the first through fifth embodiment, wherein the ribbon wrap portion is defined by two opposed non-parallel edges of the body member.

In a seventh embodiment this invention provides a balloon sealing and display device as in any of the first through sixth embodiments, wherein the non-parallel edges define a tapered neck extending from an inner end to a distal end, said tapered neck widening as it extends from said inner end to said distal end.

In a eighth embodiment this invention provides a balloon sealing and display device as in any of the first through seventh embodiment, wherein the non-parallel edges are angled relative to each other at an angle of from 5° to 45°.

In a ninth embodiment this invention provides a balloon sealing and display device as in any of the first through eighth embodiments, wherein a majority of the length of the ribbon is wound around the tapered neck, and the second end of the ribbon is exposed for access, whereby the ribbon may be axially unwound from the tapered neck by pulling the second end of the ribbon in the direction from the inner end to the distal end of the tapered neck.

In a tenth embodiment this invention provides a balloon sealing and display device as in any of the first through ninth embodiments, wherein the non-parallel edges are substantially straight and uninterrupted from the inner end to the distal end of the tapered neck.

In a eleventh embodiment this invention provides a balloon sealing and display device as in any of the first through tenth embodiments, wherein the disk-like body member is formed of a biodegradable material.

In a twelfth embodiment this invention provides a balloon sealing and display device as in any of the first through eleventh embodiments, wherein the ribbon is formed of a biodegradable material.

In a thirteenth embodiment this invention provides a balloon sealing and display device as in any of the first through twelfth emboidments, wherein the disk-like body member includes at least one window defined by material removed from the disk-like body member.

In a fourteenth embodiment this invention provides a balloon sealing and display device as in any of the first through thirteenth embodiments, wherein the window is provided in the ribbon wrap portion.

In a fifteenth embodiment this invention provides a balloon display device comprising a balloon sealing and display device and a balloon. The balloon sealing and display device includes a disk-like body member that includes a first sealing slit formed therein, extending from an open mouth inwardly to a closed end. The disk-like body member also includes a second sealing slit formed therein extending from an open mouth inwardly to a closed end. The closed end of the first sealing slit and the closed end of the second sealing slit are spaced apart from one another to define a neck wrap portion of the body member. The disk-like body member also includes a ribbon wrap portion. The balloon sealing and display device also includes a ribbon, having a first end and a second end defining a length thereof, having the first end secured to the body member. The balloon of the balloon display includes a neck, said neck being wound about said neck wrap portion, so the balloon is secured to the disk-like body member.

In a sixteenth embodiment this invention provides a balloon display device as in the fifteenth embodiment, wherein the balloon neck is stretched and the neck is received into the first sealing slit, passing through the first sealing slit and pulled taut at said first closed end, the balloon neck further being wrapped over the neck wrap portion and pulled through the second sealing slit, passing through the second sealing slit and pulled taut at the second closed end, and the balloon neck further being pulled under the neck wrap portion and back through the first sealing slit, thereby sealing the balloon neck without having to tie the neck.

In a seventeenth embodiment this invention provides a balloon display device as in the fifteenth or sixteenth embodiments, wherein the first end of the ribbon is secured at the neck wrap portion.

In a eighteenth embodiment this invention provides a balloon display device in any of the fifteenth through seventeenth embodiments, wherein the ribbon wrap portion is defined by two opposed non-parallel edges of the body member and wherein the non-parallel edges define a tapered neck extending from the inner end to the distal end of the tapered neck. The tapered neck widens as it extends from its inner end to its distal end.

In a nineteenth embodiment this invention provides a balloon display device in any of the fifteenth through eighteenth embodiments, wherein the non-parallel edges are angled relative to each other at an angle of from 5° to 45°.

In a twentieth embodiment this invention provides a balloon display device in any of the fifteenth through nineteenth embodiments, wherein a majority of the length of the ribbon is wound around the tapered neck, and the second end of the ribbon is exposed for access, whereby the ribbon may be axially unwound from the tapered neck by pulling the second end of the ribbon in the direction from the inner end to the distal end of the tapered neck.

It will be appreciated that balloons, particularly lighter-than-air balloons (such as those filled with helium), are often displayed on the end of a ribbon or string. The term "ribbon" is employed herein, but it is to cover all similar string-like or ribbon-like items.

DETAILED DESCRIPTION OF ILLUSTRATIVE EMBODIMENTS

Figure 1:
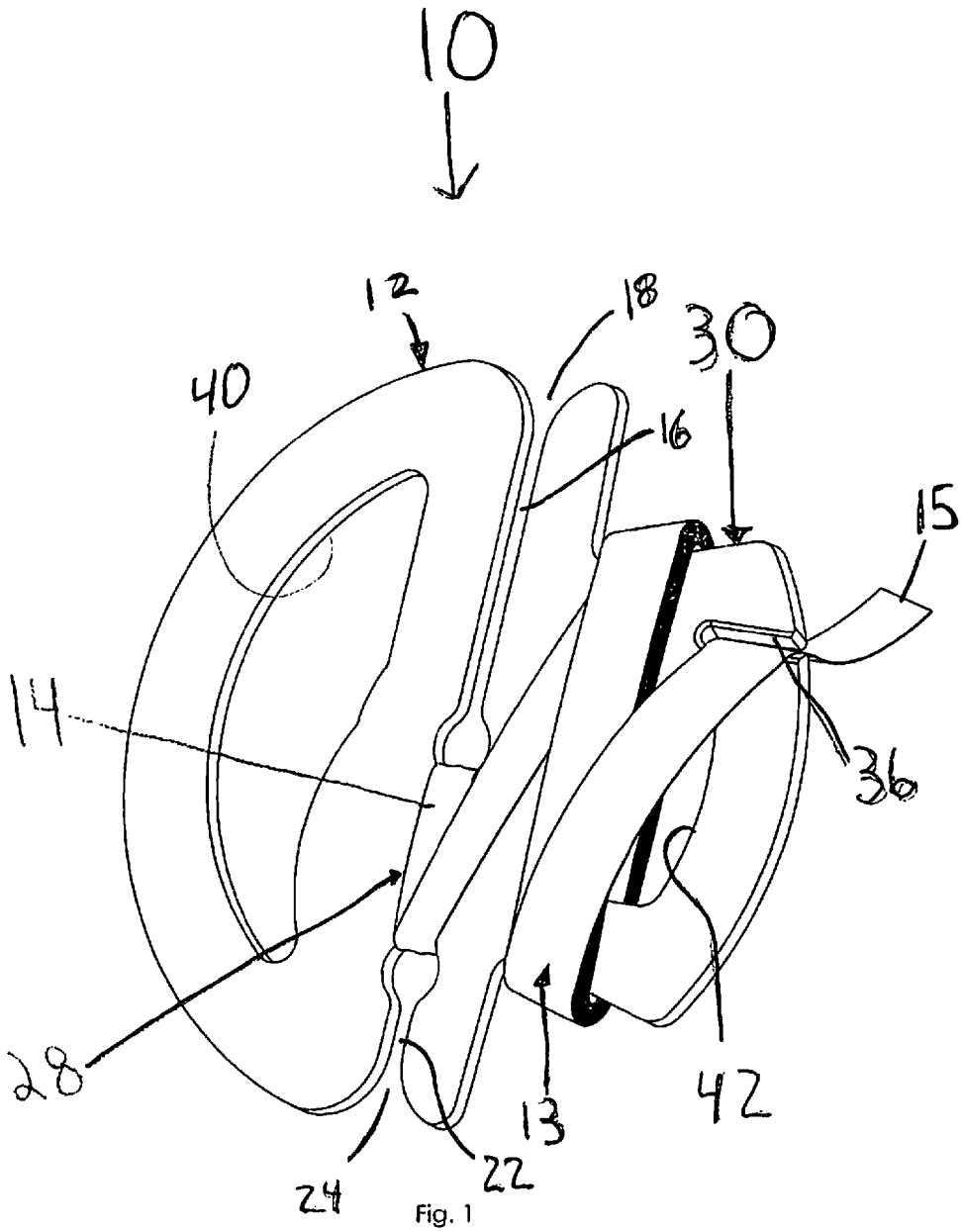
FIG. 1 is a bottom perspective view of an embodiment of the balloon sealing and display device in accordance with this invention.
Figure 2:
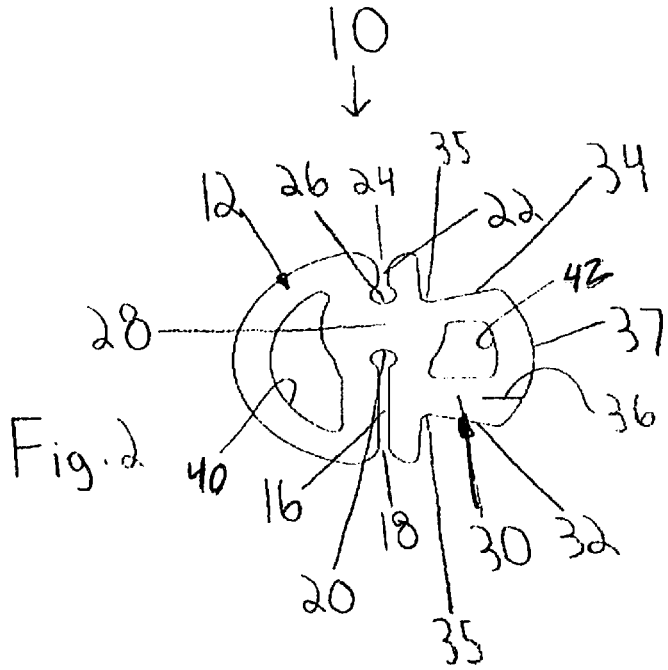
FIG. 2 is a top plan view of the disk-like body member of the balloon sealing and display device of FIG. 1.

Referring to FIGS. 1 and 2 a balloon sealing and display device of this invention is shown and designated by the numeral 10. The device 10 includes a disk-like body member 12 having a ribbon 13 secured thereto. The body member 12 includes a first sealing slit 16, with a first open mouth 18 and a first closed end 20, and a second sealing slit 22, with a second open mouth 24 and a second closed end 26. In some embodiments, the closed ends 20 and 26 may be closed in the form of virtually any shape. In a particular embodiment, the closed ends 20 and 26 are closed in a rounded or semi-circular shape, as shown. The first close end 20 and the second close end 26 are spaced apart from one another to define a neck wrap portion 28 of the body member 12. The device 10 shown in FIG. 1 also contains a ribbon wrap portion 30 with a first peripheral extension 32, a second peripheral extension 34, and a ribbon slit 36. The first peripheral extension 32 and second peripheral extension 34 are two opposed non-parallel edges of the disk-like body member 12, which are substantially straight and uninterrupted from an inner end 35 of the ribbon wrap portion 30 to a distal end 37 of the ribbon wrap portion 30, and they define a tapered neck, which widens as it extends from the inner end 35 to the distal end 37. The non-parallel edges provided by the first peripheral extension 32 and second peripheral extension 34 are angled relative to each other at an angle from 5° to 45°. In a particular embodiment, the non-parallel edges are angled relative to each other at an angle from 10° to 30°. In yet another particular embodiment, the non-parallel edges are angled relative to each other at an angle from 10° to 20°.

To complete the balloon sealing and display device 10, the ribbon 13 is secured thereto. The ribbon 13 has a first end 14 and a second end 15, which define the length of the ribbon. As seen in FIG. 1, the ribbon 13 has its first end 14 secured at the neck wrap portion 28, simply by tying or adhering or otherwise securing the first end 14 to the neck wrap portion 28 between the first and second closed end 20, 26. From the securing of the ribbon 13 at the neck wrap portion 28, a majority of its length is wound around the ribbon wrap portion 30, and the second end 15 of the ribbon 13 is received into the ribbon slit 36 which is sized to receive the ribbon 13 to pinch and hold the ribbon 13 in place as shown.

As seen in FIG. 2, the disk-like body member 12 has a window 40 and a second window 42. The removal of the material from the windows 40 and 42 leads to a decreased weight of the device 10 which in turn allows the device 10 to have a increased float time.

Figure 3:
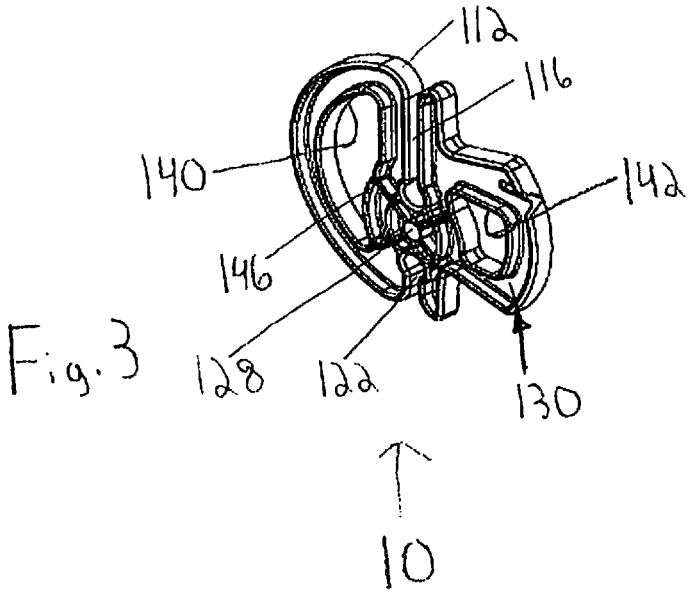
FIG. 3 is a bottom perspective view of a second embodiment of a disk-like body member.

A second embodiment of a disk-like body member as shown in FIG. 3 and distinguished by the numeral 112, like parts to those of the embodiment of FIGS. 1 and 2 receiving like numerals, though increased by 100. Thus, the disk-like body member 112, includes a first sealing slit 116, a second sealing slit 122, a neck wrap portion 128, a ribbon wrap portion 130, a window 140, and a second window 142 substantially as described above. The disk-like body member 112 is mainly distinguished from the disk-like body member 12 by the fact that the majority of the material forming the body has been removed from the back side of the body member 112 so as to define ridges 146. The material removed from the back side of the body member 112, combined with the windows 140 and 142 allow for the device 10 to be of a decreased weight which will add to the float time of the device 10. The ridges 146 help retain strength.

Figure 4:
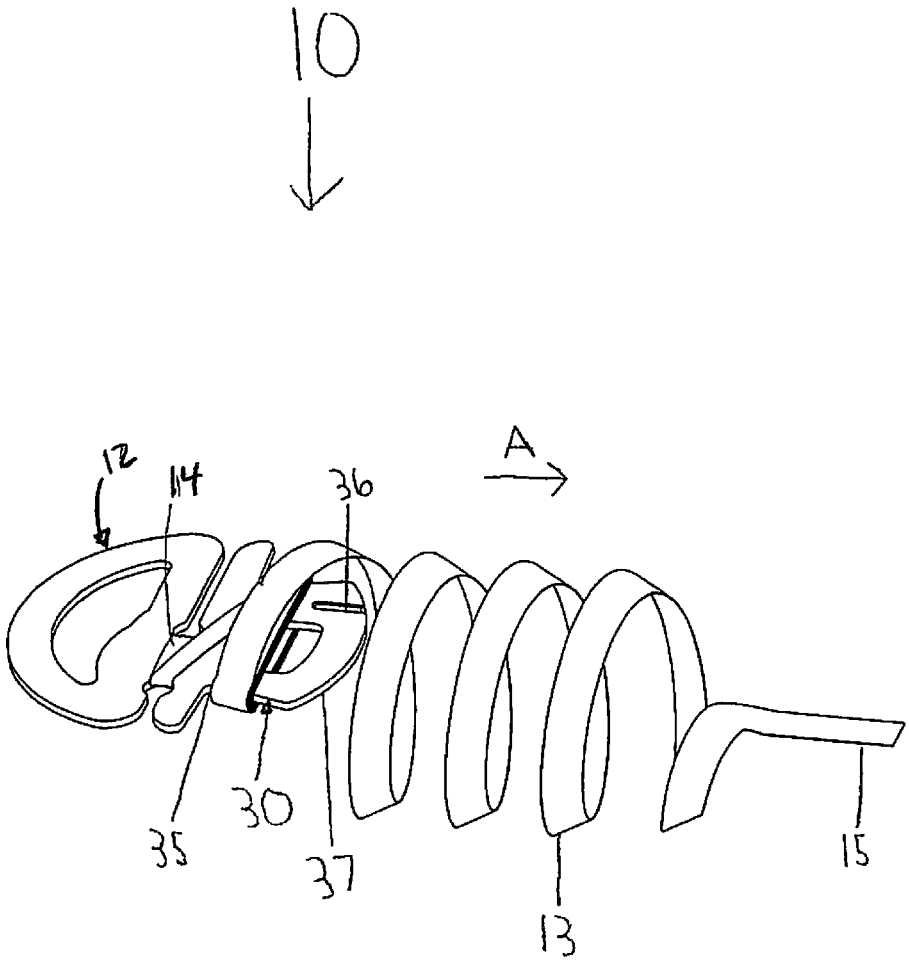
FIG. 4 is a bottom perspective view of the balloon sealing and display device as shown with a ribbon being axially unwound from a ribbon wrap portion thereof.

With the structure disclosed, the ribbon 13 can beneficially be axially unwound from the ribbon wrap portion 30. To axially unwind the ribbon 13 an individual would grab the second end 15 of the ribbon 13 which is secured in the ribbon slit 36, as shown as being exposed for access in FIG. 1. The individual would then pull the second end 15 of the ribbon 13 in the direction of arrow A. The ribbon 13 will then slip off the ribbon wrap portion 30, unwinding axially, without having to manually unwind the ribbon 13 in a circumferential direction. The ribbon 13 of the device 10 is shown in FIG. 4 as having been axially unwound from the ribbon wrap portion 30 by having the second end 15 of ribbon 13 being pulled out of the ribbon slit 36 in the direction from the inner end 35 of the ribbon wrap portion 30 to the distal end 37 of the ribbon wrap portion 30. This axial unwinding is possibly due to the uninterrupted nature of the non-parallel edges of the first and second peripheral extensions 32, 34. Notably, the ribbon wrap portion 30 is devoid of a distal flange, which would serve as an impediment to axial unwinding, as would be the case with a common spool.

Figure 5:
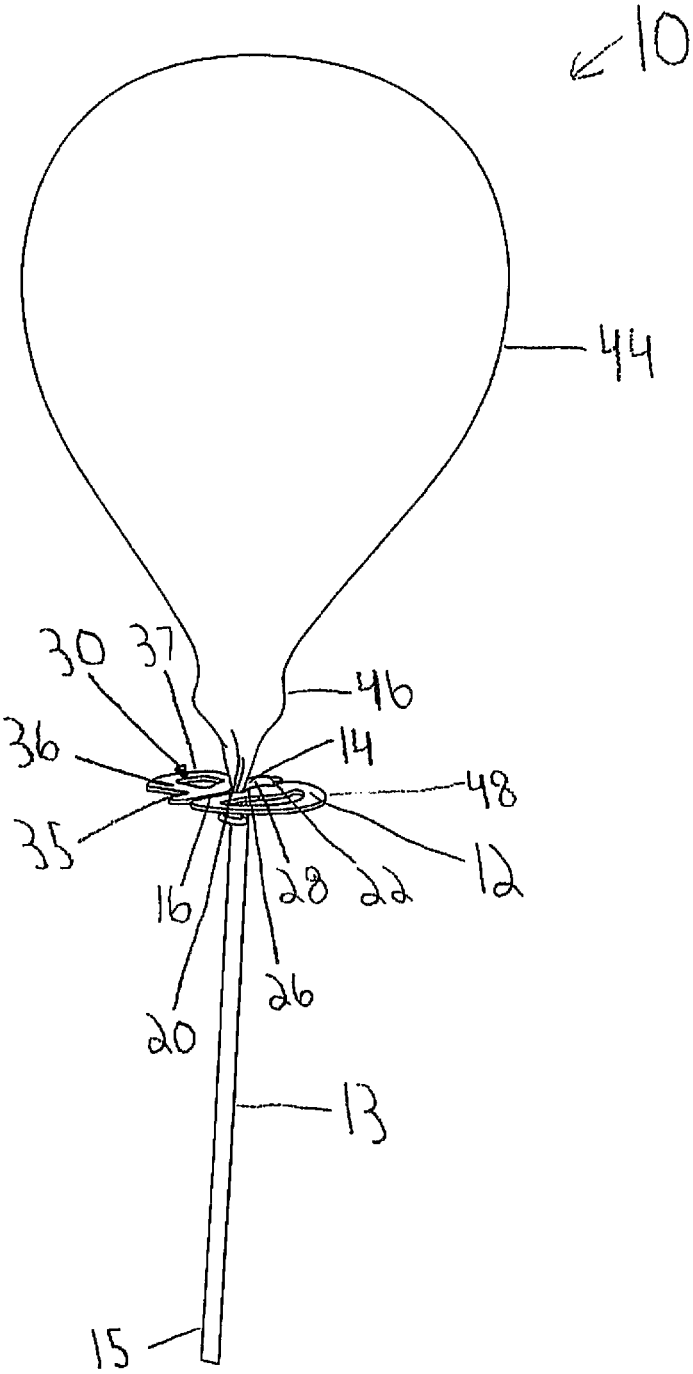
FIG. 5 is a side perspective view of a balloon display employing the balloon sealing and display device of this invention with a balloon secured thereto.

A balloon display employing the device 10 is shown in FIG. 5. The balloon display 48 is provided by securing a balloon 44 to the balloon sealing and display device 10. The balloon 44 is shown has having a neck 46 which is wound about the neck wrap portion 28 so that the balloon 44 is secured to the disk-like body member 12. The balloon 44 is secured by having its neck 46 stretched and then received into the first sealing slit 16; the neck 46 is then passed through the first sealing slit 16 and is pulled taut at the first closed end 20. Then, the neck 46 is further stretched and wrapped over the neck wrap portion 28 and pulled through the second sealing slit 22 and is pulled taut at the second closed end 26. Finally, the neck 46 is pulled under the neck wrap portion 28 and pulled back through the first sealing slit 16, thereby sealing the balloon 44, without ever having to tie the neck 46. The first end 14 of the ribbon 13 is secured at the neck wrap portion 28 such that the neck 46 wraps around that portion of the ribbon. The length of ribbon 13 is shown as being unwound from the ribbon wrap portion 30, presenting the balloon 44 as floating on the end of the ribbon 13.

In some embodiments, the disk-like body member 12 may be formed from virtually any solid material. In some embodiments, the disk-like body member 12 is made from polypropylene, polyethylene, and/or high-impact polystyrene. In some embodiments, the disk-like body member 12 is made to be biodegradable. In a particular embodiment, the biodegradable material is a polylactic acid (PLA) such as Cereplast™ (Cereplast™, El Segundo, Calif.).

In some embodiments, the ribbon 13 may be formed from virtually any solid material. In some embodiments, the ribbon 13 is made from polypropylene, polyethylene, and/or polyester. In some embodiments, the ribbon 13 is made to be biodegradable. In a particular embodiment, the biodegradable material is cotton.

In light of the foregoing, it should be appreciated that the present invention significantly advances the art by providing a balloon sealing and display device that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A balloon sealing and display device comprising:

a. a disk-like body member including:

i. a first sealing slit formed in said body member and extending from a first open mouth inwardly to a first closed end, ii. a second sealing slit formed in said body member and extending from a second open mouth inwardly to a second closed end, said first closed end of said first sealing slit and said second closed end of said second sealing slit being spaced from one another to define a neck wrap portion, and iii. a ribbon wrap portion defined by two opposed non-parallel edges of said body member, said non-parallel edges defining a tapered neck extending from an inner end to a distal end, said tapered neck widening as it extends from said inner end to said distal end; and b. a ribbon having a first end and a second end defining a length thereof, said first end of said ribbon secured to said body member, and a majority of the length of said ribbon wrapped around said ribbon wrap portion.

2. The balloon sealing and display device of claim 1, wherein said first end of said ribbon is secured at said neck wrap portion.

3. The balloon sealing and display device of claim 1, further comprising a ribbon slit in said body member sized to receive said ribbon therein and pinch and hold the same.

4. The balloon sealing and display device of claim 3, wherein said ribbon slit is formed in said ribbon wrap portion.

5. The balloon sealing and display device of claim 1, wherein said non-parallel edges are angled relative to each other at an angle of from 5° to 45°.

6. The balloon sealing and display device of claim 1, wherein a majority of said length of said ribbon is wound around said tapered neck, and said second end is exposed for access, whereby said ribbon may be axially unwound from the tapered neck by pulling the second end of said ribbon in the direction from said inner end to said distal end of said tapered neck.

7. The balloon sealing and display device of claim 1, wherein said non-parallel edges are substantially straight and uninterrupted from said inner end to said distal end of the tapered neck.

8. The balloon sealing and display device of claim 1, wherein said disk-like body member is formed of a biodegradable material.

9. The balloon sealing and display device of claim 1, wherein said ribbon is formed of a biodegradable material.

10. The balloon sealing and display device of claim 1, wherein said disk-like body member includes at least one window defined by material removed from the disk-like body member.

11. The balloon sealing and display device of claim 10, wherein said window is provided in said ribbon wrap portion.

12. A balloon display comprising:

a. a balloon sealing and display device comprising:

i. a disk-like body member including:

1. a first sealing slit formed in said body member and extending from a first open mouth inwardly to a first closed end, 2. a second sealing slit formed in said body member and extending from a second open mouth inwardly to a second closed end, said first closed end of said first sealing slit and said second closed end of said second sealing slit being spaced from one another to define a neck wrap portion, and 3. a ribbon wrap portion defined by two opposed non-parallel edges of said body member, said non-parallel edges defining a tapered neck extending from an inner end to a distal end, said tapered neck widening as it extends from said inner end to said distal end;

ii. a ribbon having a first end and a second end defining a length thereof, said first end of said ribbon secured to said body member; and b. a balloon having a neck, said neck being wound about the neck wrap portion through said first and second sealing slits defining the neck wrap portion, so that the balloon is secured to the disk-like body member and sealed at said neck wrap portion and sealing slits.

13. The balloon display of claim 12, wherein the balloon neck is stretched and the neck is received into the first sealing slit, passing through said first sealing slit and pulled taut at said first closed end, the balloon neck further being wrapped over said neck wrap portion and pulled through said second sealing slit, passing through said second sealing slit and pulled taut at said second closed end, and the balloon neck further being pulled under said neck wrap portion and back through said first sealing slit, thereby sealing the balloon neck, without tying said neck.

14. The balloon display of claim 12, wherein said first end of said ribbon is secured at said neck portion.

15. The balloon display of claim 12, wherein said non-parallel edges are angled relative to each other at an angle of from 5° to 45°.

16. The balloon display of claim 12, wherein a majority of said length of said ribbon is wound around said tapered neck, and said second end is exposed for access, whereby said ribbon may be axially unwound from the tapered neck by pulling the second end of said ribbon in the direction from said inner end to said distal end of said tapered neck.

* * * * *